US005974622A

United States Patent [19]

Louis et al.

[11] Patent Number: 5,974,622

[45] Date of Patent: Nov. 2, 1999

[54] TRANSMISSION NEUTRAL LOCKING ARRANGEMENT FOR A SELF-PROPELLED VACUUM CLEANER

[75] Inventors: Jeffrey S. Louis, Green; Jeffery A. Morgan, Cuyahoga Falls; Vincent L. Weber, North Lawrence; Glenn E. Specht, Massillon; Kenneth L. Symensma, Canton, all of Ohio

[73] Assignee: The Hoover Company, North Canton, Ohio

[21] Appl. No.: 09/075,352

[22] Filed: May 8, 1998

[51] Int. Cl.[6] ..... A47L 9/00

[52] U.S. Cl. ..... 15/340.2; 15/383

[58] Field of Search ..... 15/340.1, 340.2, 15/340.3, 383

[56] References Cited

U.S. PATENT DOCUMENTS

| | | | |
|---|---|---|---|
| 306,008 | 9/1884 | Drew | 15/41.1 |
| 1,081,209 | 12/1913 | Carr | 15/347 |
| 1,152,726 | 9/1915 | Hackney | 15/359 |
| 1,294,473 | 2/1919 | Kirby | 15/389 |
| 1,332,235 | 3/1920 | Staples | 474/119 |
| 1,438,890 | 12/1922 | Bobst | 15/390 |
| 1,465,285 | 8/1923 | Peterson | 15/340.3 |
| 1,565,692 | 12/1925 | Walter | 451/352 |
| 2,174,560 | 10/1939 | Becker | 15/333 |
| 2,601,698 | 7/1952 | Humphrey | 15/390 |
| 2,616,119 | 11/1952 | Balluff | 15/390 |
| 2,627,623 | 2/1953 | Humphrey | 15/372 |
| 2,782,435 | 2/1957 | Stone | 15/83 |
| 3,087,180 | 4/1963 | Webster | 15/79.2 |
| 3,220,043 | 11/1965 | Lampe | 15/340.2 |
| 3,448,485 | 6/1969 | Worwag | 15/332 |
| 3,581,591 | 6/1971 | Ziegler et al. | 74/377 |
| 3,618,697 | 11/1971 | Ripple et al. | 180/19.3 |
| 3,892,003 | 7/1975 | Peabody | 15/52.1 |
| 4,347,643 | 9/1982 | Bair, III | 15/340.2 |
| 4,380,846 | 4/1983 | Maurer | 15/391 |
| 4,446,594 | 5/1984 | Watanabe et al. | 15/323 |
| 4,615,071 | 10/1986 | Frohbieter | 15/340.2 |
| 4,748,714 | 6/1988 | Tschudy | 15/390 |
| 4,766,640 | 8/1988 | Martin et al. | 15/340.1 |
| 5,152,027 | 10/1992 | LaBoda | 15/83 |
| 5,504,971 | 4/1996 | McCormick | 15/340.2 |
| 5,537,712 | 7/1996 | Weber et al. | 15/391 |
| B1 4,249,281 | 12/1985 | Meyer et al. | 15/340.2 |

FOREIGN PATENT DOCUMENTS

| | | |
|---|---|---|
| 54-24222 | 8/1979 | Japan . |
| 930228 | 4/1962 | United Kingdom . |

*Primary Examiner*—Mark Spisich
*Assistant Examiner*—Theresa T. Snider
*Attorney, Agent, or Firm*—A. Burgess Lowe; Bruce P. Watson

[57] ABSTRACT

A self-propelled upright vacuum cleaner is provided having a lower portion and an upright handle portion pivotally attached to the floor engaging portion for a pivotal motion between an upright storage position and a pivotal operating position. A drive wheel mounted to the floor engaging portion. A transmission operatively connected to the drive wheel and a motor drivingly connected to the transmission for driving the drive wheel in forward and reverse. A transmission actuator arm pivotally mounted to the floor engaging portion adjacent to the transmission for pivotal motion about a pivot axis located at a central portion of the actuator arm. A manual actuator mounted to the handle portion. The manual actuator is operatively connected to the actuator arm, whereby when an operator actuates the manual actuator actuator arm pivots in first and second directions, respectively, from a neutral position, such that the actuator arm actuates the transmission to place the transmission in forward and reverse, respectively. First and second cams extend from the handle portion and are located to engage the actuator arm at two locations spaced to either side of the pivot axis of the actuator arm when the handle is raised to the upright storage position, whereby the cams place and lock the actuator arm in the neutral position when the handle portion is pivoted to the upright storage position.

16 Claims, 5 Drawing Sheets

TRANSMISSION NEUTRAL LOCKING ARRANGEMENT FOR A SELF-PROPELLED VACUUM CLEANER

BACKGROUND OF THE INVENTION

1. Field of the Invention

This invention pertains to self-propelled upright vacuum cleaners. More specifically, this invention pertains to a novel transmission neutral locking structure for automatically placing and locking the transmission on a self-propelled upright vacuum cleaner in its neutral position when the handle or bag housing portion of the cleaner is placed in its upright storage position.

This invention also pertains to an upright vacuum cleaner having a structure for automatically engaging and rotating the agitator when the bag housing is located in a generally inclined operating position and automatically disengaging and stopping rotation of the agitator when the bag housing is located in the upright storage position, which structure may also be manually actuated to maintain disengagement of the agitator for cleaning bare floors.

2. Description of Related Prior Art

It is known in the prior art to provide an upright vacuum cleaner with a transmission in the foot or lower floor engaging portion of the cleaner and a transmission actuator member mounted to the foot adjacent to the transmission. A Bowden cable typically extends from the actuator on the foot to a hand grip that is reciprocally mounted for rectilinear motion to the top of the bag housing or handle portion of the cleaner. In order to prevent accidental engagement of the transmission when the bag housing is in the upright storage position, it is also known to provide a member on the lower end of the bag housing or handle portion of the vacuum cleaner that will engage the transmission actuator, or actuate a member on the foot that engages the transmission actuator, and thereby place and lock the transmission actuator in its neutral position. Thus, if an operator were to accidentally bump the hand grip while the cleaner's bag housing is in the upright storage position and the motor is running, the transmission is prevented from being engaged and the cleaner is prevented from accidentally propelling itself across the floor and causing an accident. Such transmission neutral locking arrangements for self-propelled upright vacuum cleaners are disclosed in U.S. Pat. Nos. 4,766,640; 4,347,643 and 4,249,281.

It is also known to place the transmission actuator on the lower end of the bag housing such that the actuator engages and actuates the transmission when the bag housing is in its inclined operating position and does not engage the transmission when the bag housing is in its upright storage position. When the transmission is not being engaged by the actuator, the transmission is self-biased into an idling neutral position. An example of this type of self-propelled vacuum cleaner can be found in U.S. Pat. No. 3,618,687.

As disclosed in commonly owned U.S. Pat. No. 5,537,712, the disclosure of which is hereby incorporated herein as of reference, it is known to engage an agitator by pressing an idler pulley on a pivotal idler arm against the agitator drive belt, thereby placing the agitator drive belt under tension and transferring power to the agitator. It is also known to automatically engage and disengage the agitator as the handle portion of the cleaner is raised and lowered by providing a protrusion or cam on the bag housing that contacts and pivots the idler arm to lift the idler pulley out of engagement with the agitator drive belt. The U.S. Pat. No. 5,537,712 patent does not, however, disclose a means for shutting the agitator off for cleaning bare floors.

SUMMARY OF THE INVENTION

It is a further object of the present invention to provide an improved transmission neutral locking arrangement for self-propelled upright vacuum cleaners that automatically places and locks the transmission in a neutral position when the handle or bag housing portion of the vacuum cleaner is placed in it's upright latched storage position.

It is a further object of the present invention to provide an improved transmission neutral locking arrangement for self-propelled upright vacuum cleaners that automatically places and locks the transmission in a neutral position when the handle or bag housing portion of the vacuum cleaner is placed in it's upright latched storage position and releases the transmission from the locked neural position when the handle portion of the cleaner is inclined to it's operating position.

It is still a further object of the present invention to provide an improved mechanism for automatically activating and de-activating the agitator in a self-propelled upright vacuum cleaner, as the handle portion of the cleaner is moved from the upright storage to the inclined operating position and back again.

It is yet another object of the present invention to provide such an automatic agitator drive mechanism with a means for manually setting the cleaner in an agitator-off mode for cleaning bare floors.

These and other objects of the present invention are achieved by the present invention, which provides a vacuum cleaner comprising a floor engaging portion; a handle portion pivotally mounted to said floor engaging portion for pivotal motion relative said floor engaging portion between a generally upright storage position and an inclined pivotal operating position; an agitator rotatably mounted to said floor engaging portion; a motor having an output shaft; at least one belt extending from said output shaft to said agitator for selectively drivingly connecting said motor to said agitator; a idler arm pivotally mounted to said floor engaging portion for pivotal motion between an agitator-on position in which the idler arm engages said belt, thereby placing said belt under tension whereby said belt drives said agitator, and an agitator-off position in which said idler arm does not engage said belt, thereby placing said belt in a slack condition whereby said belt does not drive said agitator; a spring mounted between said floor engaging portion and said idler arm for biasing said idler arm into said agitator-on position; a tab protruding from said handle portion such that said tab i) engages said idler arm when said handle portion is pivoted into said storage position and thereby pivots said idler arm into said agitator-off position and ii) moves out of engagement with said idler arm when said handle portion is pivoted to said operating position such that said spring pivots said idler arm into said agitator-on position; and means for selectively placing said belt under tension for selectively driving the agitator.

The present invention further provides a self-propelled upright vacuum cleaner having a floor engaging portion and a generally upright handle portion pivotally attached to said floor engaging portion for a pivotal motion between a generally upright storage position and a pivotal inclined operating position, at least one floor engaging drive wheel mounted to and extending out a lower surface of said floor engaging portion, a transmission operatively connected to said drive wheel and a motor drivingly connected to said transmission for selectively driving said drive wheel in forward and reverse, wherein the improvement comprises: a transmission actuator arm pivotally mounted to said floor engaging portion adjacent to said transmission for pivotal motion about a pivot axis located generally at a central portion of said actuator arm, a manual actuator mounted to said handle portion, said manual actuator being operatively connected to the actuator arm such that when an operator actuates said manual actuator the force is transmitted from said manual actuator to said actuator arm to selectively pivot said actuator arm in first and second directions, respectively, from a neutral position such that said actuator arm actuates said transmission to place the transmission in forward and reverse, respectively; and first and second rigid protrusions extend from said handle portion and are located to engage said actuator arm at two locations spaced to either side of said pivot axis of said actuator arm when said handle is raised to said upright storage position, whereby said first and second protrusions place and lock said actuator arm in said neutral position when said handle portion is pivoted to said upright storage position.

BRIEF DESCRIPTION OF THE DRAWINGS

A preferred embodiment of the present invention will now be described, by way of example, with reference to the accompanying drawings, of which:

FIG. 2 illustrates the cleaner with the bag housing in the upright storage position and FIG. 3 illustrates the cleaner with the bag housing in the inclined operating position;

DETAILED DESCRIPTION OF THE INVENTION

Figure 1:
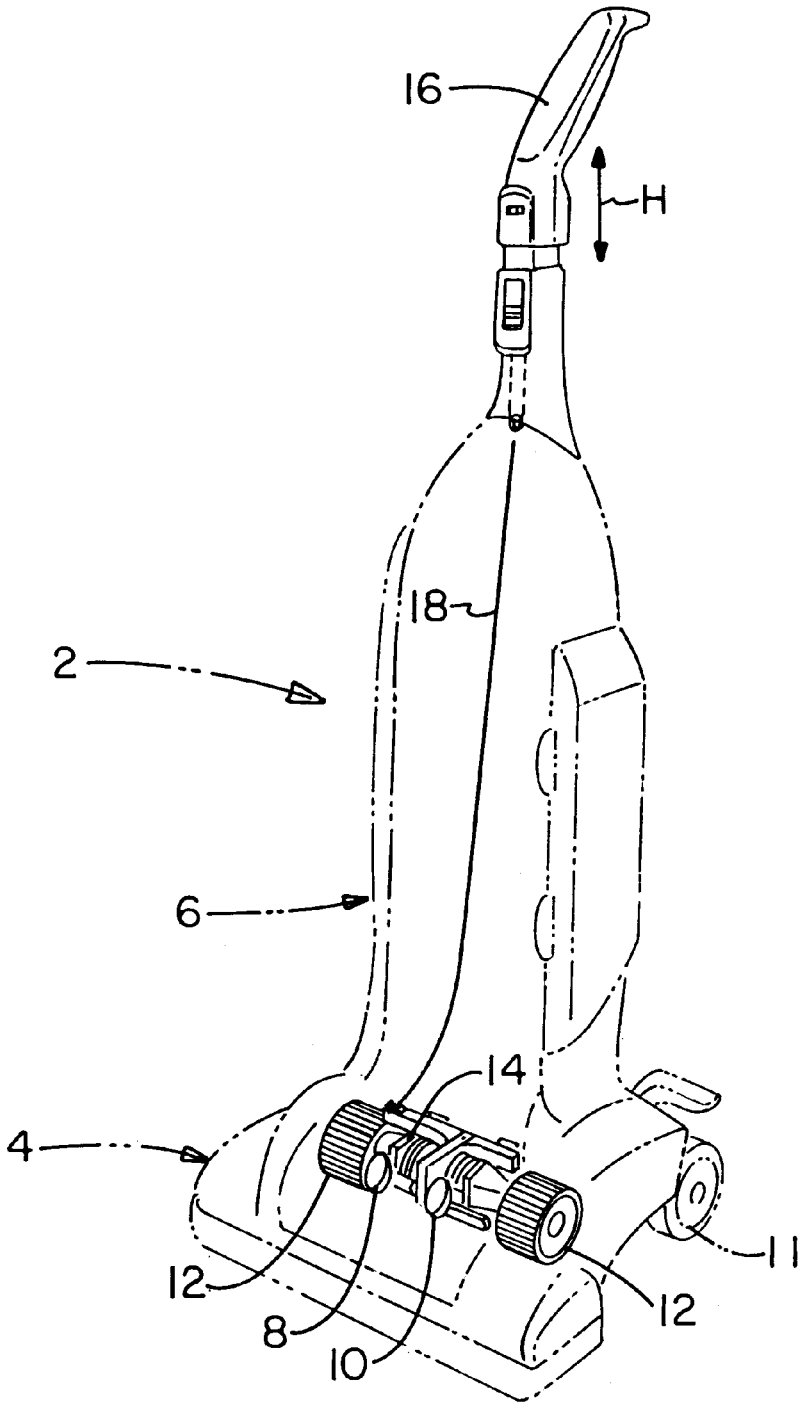
FIG. 1 is a diagrammatic perspective view of a self-propelled upright vacuum cleaner according to the present invention.

A self-propelled upright vacuum cleaner 2 according to a preferred embodiment of the present invention is diagrammatically illustrated by way of example in FIG. 1. The cleaner includes a foot or lower floor engaging portion 4 and an upper portion or bag housing 6 pivotally mounted to the lower portion in a conventional manner for pivotal motion from a generally upright latched storage position, illustrated in FIG. 1, to a generally inclined operating position, not shown. A manually actuated height adjustment knob 8 and a manually actuated agitator shut-off knob 10 are mounted to the foot. Rear support wheels 11 (only on of which is visible in FIG. 1) and drive wheels 12 cooperate to support the cleaner on a floor surface. The drive wheels are selectively driven in forward and reverse by a transmission 14.

The details of the height adjustment mechanism do not form a part of the present invention and are therefore not described in detail herein. However, a suitable height adjustment mechanism for use with a self-propelled upright vacuum cleaner according to the present invention is disclosed in U.S. Pat. No. 4,171,554, the disclosure of which is hereby incorporated herein as of reference.

A hand grip 16 is mounted to a top of the bag housing 6 for limited reciprocal rectilinear motion relative to the bag housing as indicated by arrow H in FIG. 1. The hand grip is connected to the transmission 14 via a Bowden type control cable 18 in order to enable the transmission to be automatically actuated to drive the cleaner in forward and reverse as an operator respectively pushes and pulls on the hand grip.

The details of the transmission do not form a part of the present invention and are therefore not disclosed in detail herein. However, a suitable transmission for use with a self-propelled upright vacuum cleaner according to the present invention is disclosed in expired U.S. Pat. No. 3,581,591, the disclosure of which is hereby incorporated herein as of reference. Likewise, the details of the reciprocating hand grip do not form a part of the present invention and are therefore not described in detail herein. Suitable hand grips for use with a self-propelled upright vacuum cleaner according to the present invention are disclosed in U.S. Pat. Nos. 3,618,687 and 5,339,916, the disclosures of which are hereby incorporated herein as of reference.

Figure 2:
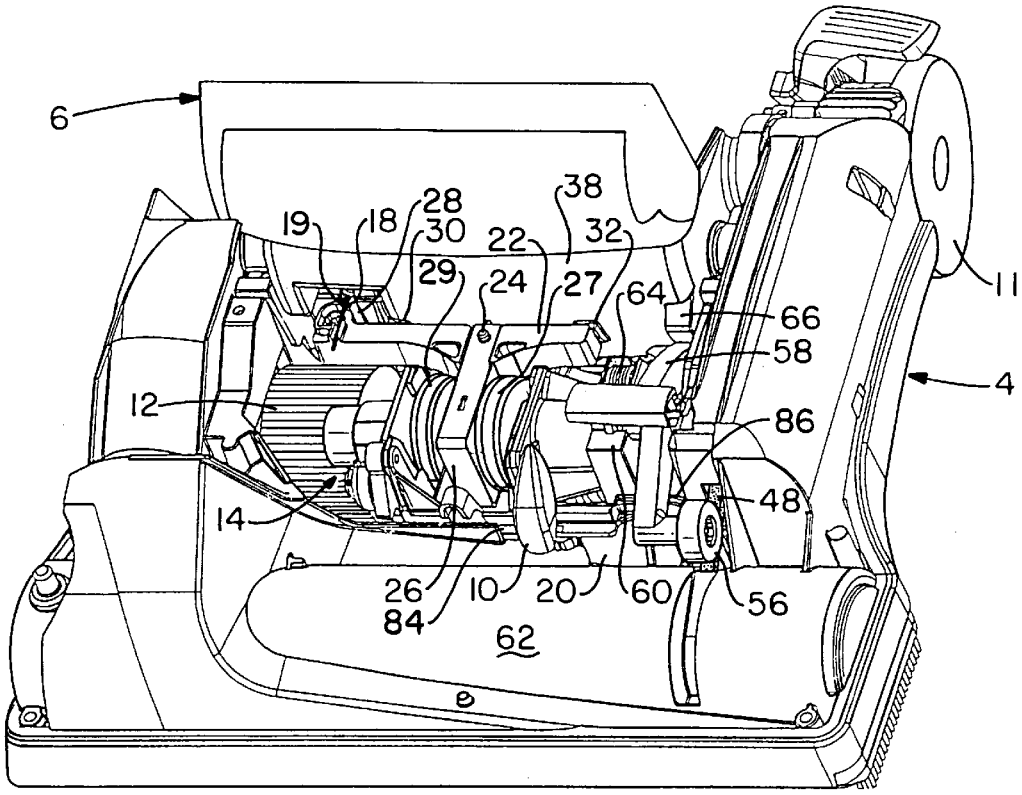
FIGS. 2 and 3 are partial perspective views of the self-propelled upright vacuum cleaner shown in FIG. 1 with the hood or housing on the lower portion of the cleaner removed.

Referring now to FIG. 2, the transmission 14 is mounted to the front edge of a main frame or carriage 20 and the pair of drive wheels 12 (only one of which is visible in FIG. 2) are mounted to the transmission's output shaft (not shown in FIG. 2). The drive wheels are located toward the front of the carriage 20, the support wheels 11 are located to the rear of the carriage and the bag housing 6 is pivotally mounted to the carriage between the drive wheels and the support wheels, such that the support wheels and the drive wheels cooperate to support the weight of the cleaner on a floor surface.

A transmission actuator arm 22 is pivotally mounted on a mounting post 24 extending up from the carriage 20 adjacent to the transmission 14. A clutch engaging member 26 is mounted on the actuator arm. A lower end of the control cable 18 is attached to the actuator arm 22 at a location spaced from the mounting post 24. A lower end of the control cable's sheath 19 is affixed to the carriage 20 on a support column 28 that is preferably integrally molded into the carriage. The support column may alternatively be molded into the transmission housing. When an operator pushes on the hand grip 16, the control cable pivots the actuator arm in a first direction about the mounting post, such that the clutch engaging member 26 engages the forward drive clutch 27 of the transmission for propelling the cleaner forward across the floor. Likewise, when an operator pulls on the hand grip, the control cable pivots the actuator arm in a second, opposite direction about the mounting post, such that the clutch engaging member engages the reverse drive clutch 29 of the transmission for propelling the cleaner backward across the floor. When the hand grip is not being manipulated by an operator, the transmission remains in a relaxed neutral position in which neither clutch is engaged and the actuator arm is located in a neutral position substantially parallel to the input shaft of the transmission, as shown in FIG. 2.

Figure 3:
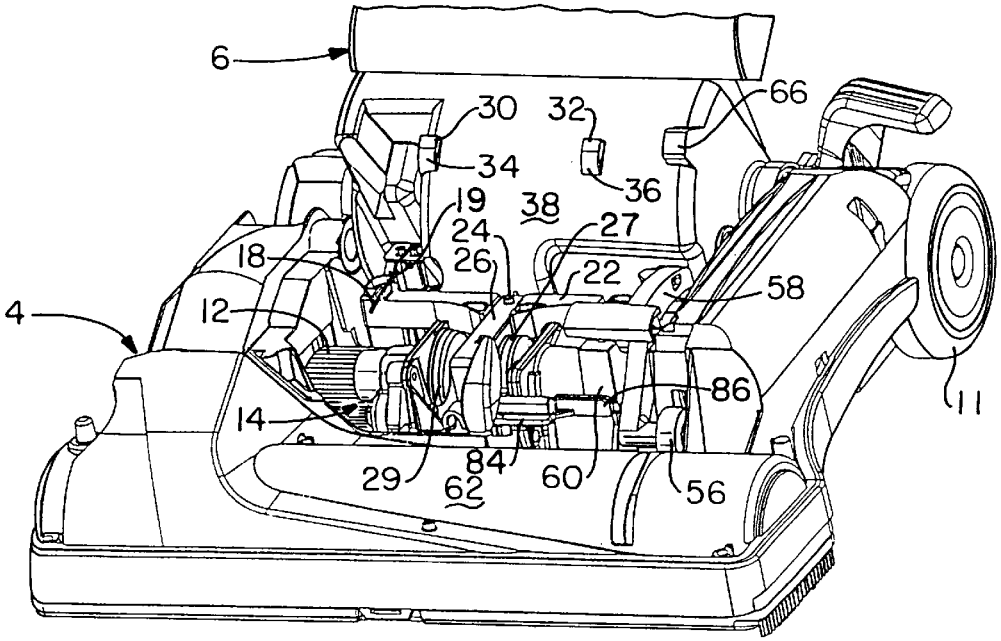
Figure 4:
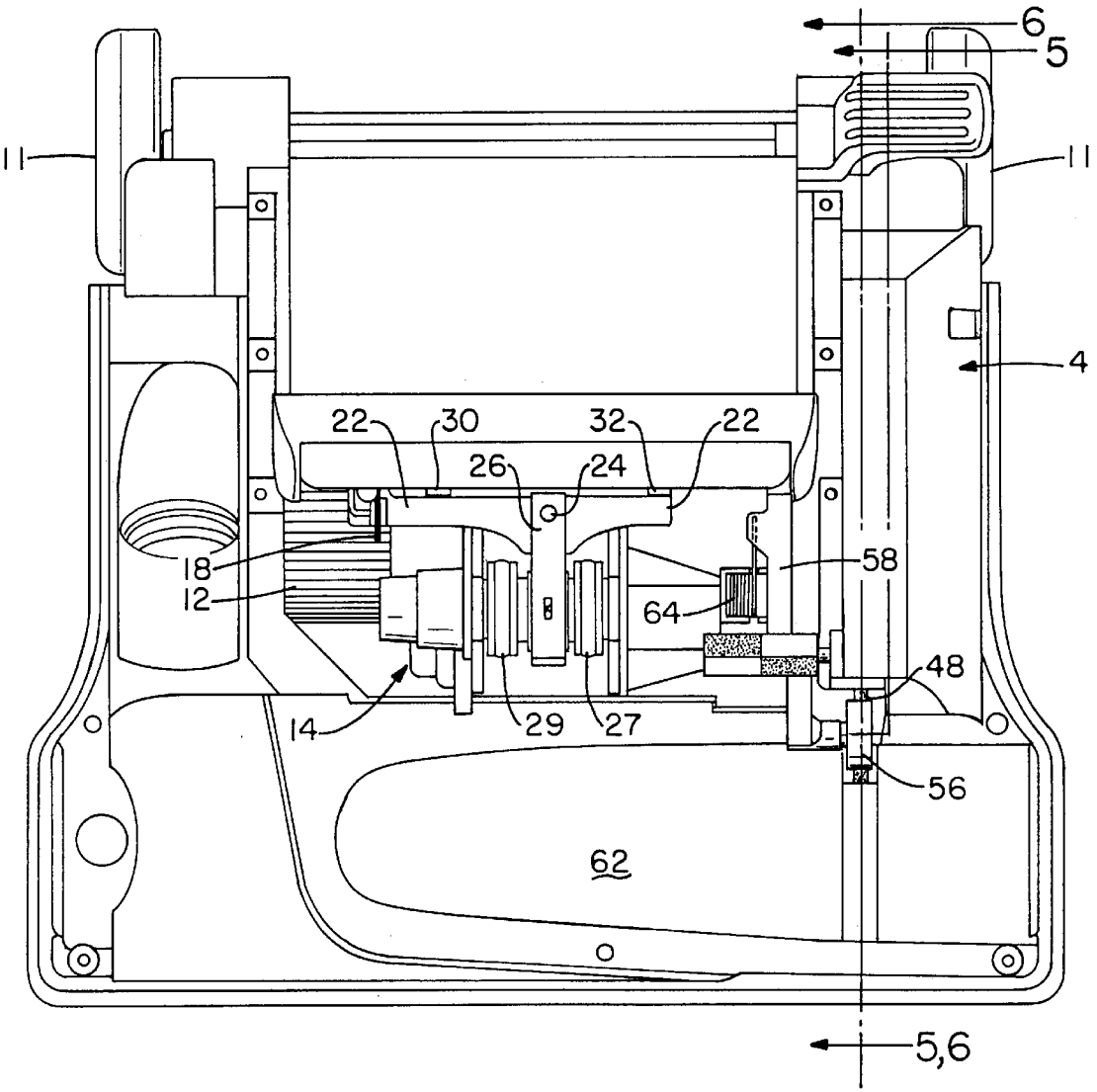
FIG. 4 is a partial top plan view of the foot portion of the vacuum cleaner with the hood removed.

First and second cams 30 and 32 (best seen in FIG. 3) are defined by bumps formed on the lower end of the bag housing 6 (best seen in FIG. 3). The first and second cams are positioned on the bag housing such that, when the bag housing is in the upright storage position, the cams engage the actuator arm 22 at two locations spaced to either side of the actuator arm mounting post 24, such that the cams position and lock the actuator arm in the neutral position as illustrated in FIG. 2. When the bag housing is pivoted from the storage position to the inclined operating position, as illustrated in FIG. 3, the first and second cams 30 and 32 move up out of engagement with the actuator arm 22, such that the actuator arm is free to pivot about the mounting post 24 and actuate the transmission 14. Lower surfaces 34 and 36 of the first and second cams are inclined, so that as the first and second cams engage the actuator arm when the bag housing 6 is pivoted from the inclined operating position illustrated in FIG. 3 to the upright storage position illustrated in FIG. 2, the inclined lower surfaces 34 and 36 of the first and second cams contact the actuator arm 22 and cammingly pivot the actuator arm into the neutral position. With this construction, the actuator arm is placed and securely locked on the neutral position by the first and second cams when the bag housing is placed in the upright storage position and accidental engagement of the transmission is prevented.

Figure 5:
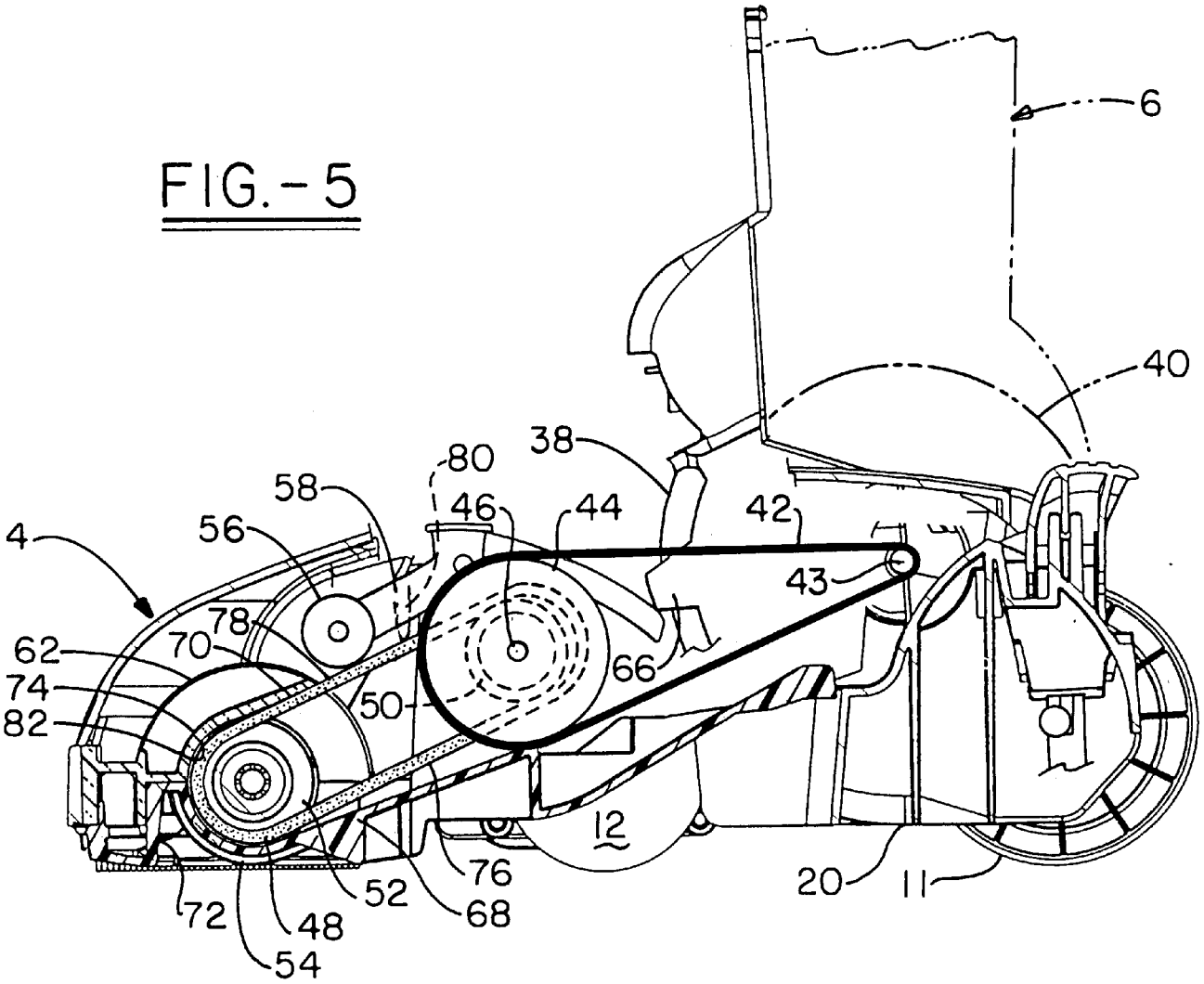
FIG. 5 is a partially broken away cross-sectional view taken along line V—V in FIG. 4 with the bag housing in the upright storage position.
Figure 6:
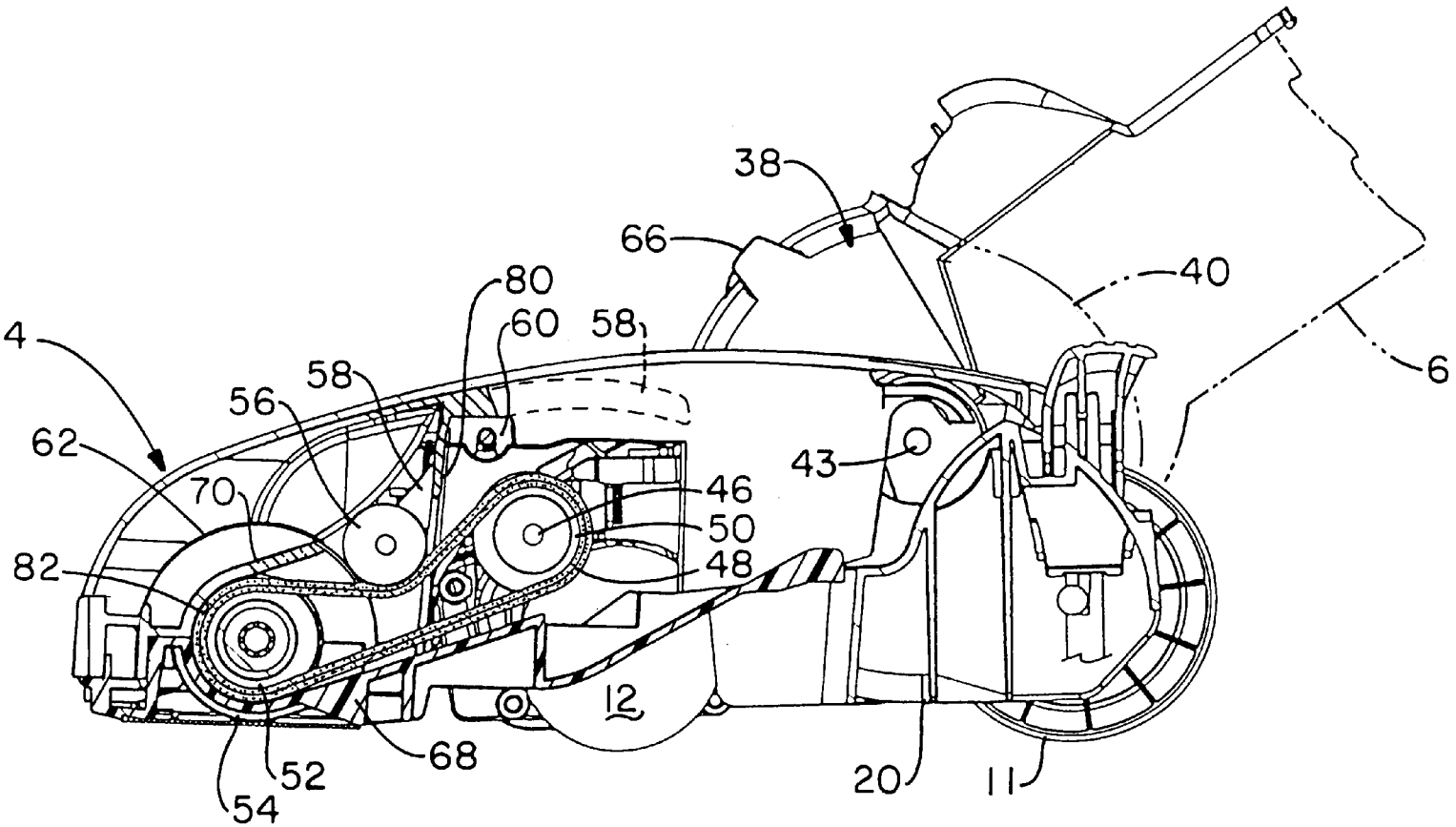
FIG. 6 is a cross-sectional view taken along line VI—VI in FIG. 4 with the bag housing in the inclined operating position.

Referring now to FIGS. 5 and 6, the lower end of the bag housing 6 defines a motor housing 38 enclosing an electric motor 40 for powering the cleaner. A drive belt 42 extends from the motor's output shaft 43 to a first pulley 44 (not shown in FIG. 6) fixed on the input shaft 46 of the power drive transmission 14. An agitator belt 48 extends from a second pulley 50 (shown in ghost in FIG. 5) fixed on the transmission input shaft to a third pulley 52 integrally formed on the agitator 54. The second pulley preferably has a smaller diameter than the first pulley and the third pulley preferably has a diameter that is equal to the diameter of the second pulley, thereby creating a speed reduction from the first pulley to the third pulley. The second and third pulleys each preferably have a diameter of 1.5 inches and the third pulley preferably has a diameter of 2.36 inches.

The agitator belt 48 has a length that is greater than the distance between the second pulley 50 and the agitator 54, such that there is slack in the agitator belt as illustrated in FIG. 5. In order to engage the agitator, an idler pulley 56 is mounted on the end of an idler arm 58 pivotally mounted in a cradle 60 integrally molded into agitator housing 62 adjacent to the agitator belt 48. A spiral torsion spring 64 (illustrated in FIG. 2) is mounted in the cradle in compression between the cradle and the idler arm 58. The torsion spring biases the idler arm in a first direction about its pivot axis and presses the idler pulley 56 against the agitator belt as illustrated in FIG. 6, thereby placing the agitator belt under tension and transferring power from the second pulley 50 to the agitator 54.

A protrusion or third cam 66 (not shown in FIG. 5) is integrally molded into the motor housing 38 and is located so that as the handle portion 6 is raised to the storage position, the protrusion 66 contacts the idler arm 58 (as seen in FIG. 2) and pivots the idler arm in a second direction about its pivot axis, opposite the first direction, thereby moving the idler pulley 56 out of engagement with the agitator belt 48 as illustrated in FIG. 5, thereby disengaging the agitator from the second pulley 50 and from the motor 40.

Using the idler pulley 56 to place the agitator belt 48 under tension makes it possible to employ a V-belt formed of rubber reinforced with a relatively stiff, inelastic and durable cord material to transmit power from the second pulley to the agitator. The agitator belt has an initial circular shape or configuration. Such a V-belt is durable enough to last for virtually the lifetime of the vacuum cleaner under normal conditions, thereby significantly reducing the need to replace the agitator belt. The drive belt 42, on the other hand, is preferably a conventional stretch belt having a flat or rectangular shape in cross-section that is preferably formed of a relatively elastic rubber material. The length of the drive belt 42 is less than the distance between the motor shaft 43 and the first pulley 44, whereby the drive belt must be stretched to be mounted between the motor shaft and the first pulley. Thus, the drive belt is mounted under tension, such that the natural elasticity of the drive belt maintains the drive belt under tension for transmitting power from the motor 40 to the transmission 14.

The drive belt according to the present invention is less expensive and less durable than the agitator belt. The drive belt is designed to slip on the motor's output shaft when the agitator is accidentally stalled. Thus, the drive belt serves as an overload clutch that allows the motor to continue to rotate when the agitator stalls, thereby preventing the motor from being stalled and burning out. As a result of its less durable nature and its function as an overload clutch, the drive belt will likely require replacement during the lifetime of the vacuum cleaner under normal operating conditions. As discussed above, the agitator belt is designed to last considerably longer than the drive belt. Therefore, the second pulley 50 is located on the transmission input shaft inside of the first pulley 44, so that the agitator belt 48 does not have to be removed in order to replace the drive belt 42.

Still referring to FIGS. 5 and 6, lower and upper belt guides 68 and 70 are molded into a bottom plate 72 and into a top plate 74 of the agitator housing 62. The lower belt guide 68 formed in the bottom plate is a vertical wall having an inclined top surface or edge that lies adjacent and generally parallel to a lower expanse 76 of the agitator belt 48. The upper belt guide 70 is formed by a similar wall having a lower edge that lies adjacent to an upper expanse 78 of the agitator belt. A rib 80 (not shown in FIG. 5) having a lower end adjacent to the upper expanse of the agitator belt is also molded into the top plate. The bottom plate and the top plate cooperate to define a semi-cylindrical chamber having an inner peripheral surface 82 that closely surrounds the outer peripheral surface of the agitator belt where the agitator belt is wrapped around the third pulley 52 formed on the agitator 54.

When the idler pulley 56 is moved away from the agitator belt 48, the natural stiffness and resiliency of the agitator belt causes the upper 78 and lower 76 expanses of the agitator belt to bow radially outwardly toward the agitator belts initial circular shape. Since further outward bowing of the upper and lower expanses of the agitator belt is prevented by the belt guides 68 and 70, the upper and lower expanses of the agitator belt are maintained in a substantially straight planar configuration. As the upper expanse 78 of the agitator belt straightens, the ends of the agitator belt, i.e. where the agitator belt is wrapped around the second 50 and the third 52 pulleys, move away from each other. Since the end of the agitator belt wrapped around the third pulley 52 is prevented from moving away from the third pulley by the close proximity of the inner peripheral surface 82 of the annular chamber defined by the top plate 74 and the bottom plate 72 of the agitator housing, the end of the agitator belt wrapped around the second pulley 52 moves away from the second pulley as illustrated in FIG. 5. Thus, the agitator belt 48 is lifted clear of the second pulley. It is critical that the agitator belt be lifted from the second pulley rather than the third pulley, because the second pulley is continuously driven by the motor via the drive belt 42. If the agitator belt were to remain in contact with the second pulley when not under tension, the agitator belt would slip on the second pulley, and the resulting friction would damage both the agitator belt and the second pulley.

In a preferred embodiment of the present invention, when the idler pulley 56 is located in the agitator-off position, as illustrated in FIG. 5, the outer peripheral surface of the idler pulley is substantially tangent to a plane extending from the lower surface of the upper belt guide 70 and the lower edge of the rib 80. Thus, the idler pulley cooperates with the upper belt guide and with the rib in preventing the upper expanse 78 of the agitator belt from bowing outward when the idler pulley is moved to the agitator-off position.

Referring again to FIGS. 2 and 3, the agitator shut-off knob 10 is mounted to the hood (not shown in FIGS. 2 and 3 ) on a slide 84 for reciprocal movement between an agitator-on position illustrated in FIG. 3 to an agitator-off position illustrated in FIG. 2. A finger 86 extends out from an end of the slide adjacent to the agitator belt 48 and extends toward the agitator belt. When cleaning carpeted floors, the agitator shut-off knob is located in the agitator-on position, so that the agitator is driven for agitating the carpet in a conventional manner. When it is desired to clean bare floors, the bag housing 6 is first pivoted into the latched storage position in which the idler pulley 56 is disengaged from the agitator belt 48 and the agitator is off, as illustrated in FIG. 2. The operator then slides the agitator shut-off knob 10 to the right, as viewed in FIGS. 2 and 3, into the agitator-off position illustrated in FIG. 2. When the agitator shut-off knob is in the agitator-off position, the finger 86 extends under the idler arm 58. When the operator subsequently inclines the bag housing into the operating position for cleaning the floor, the finger 86 retains the idler arm in the disengaged position, such that the agitator remains disengaged.

It will be appreciated that a manual agitator shut-off knob with a finger according to the present invention could be used in a non-propelled upright vacuum cleaner having an automatically actuated belt tensioning idler pulley, such as the cleaner disclosed in previously mentioned U.S. Pat. No. 5,537,712, in order to provide such a cleaner with an agitator-off bare floor cleaning mode of operation.

It will further be appreciated that any suitable control link may be substituted for the disclosed the Bowden control cable without departing from the scope of the present invention. For example, a flexible strap, a rigid link or a system of rigid links may be substituted for the control cable. Similarly, a drive belt has been disclosed for drivingly connecting the motor to the transmission. One of skill in the art will also recognize that the transmission may alternatively be connected to the motor by any suitable drive train, such as a gear train for example.

The present invention has been described above using a preferred embodiment by way of example only. Obvious modifications within the scope of the present invention will become apparent to one of ordinary skill upon reading the above description and viewing the appended drawings. The present invention described above and as claimed in the appended claims is intended to include all such obvious modifications within the scope of the present invention.

What is claimed is:

1. A self-propelled upright vacuum cleaner having a floor engaging portion and a generally upright handle portion pivotally attached to said floor engaging portion for a pivotal motion between a generally upright storage position and a pivotal inclined operating position, at least one floor engaging drive wheel mounted to and extending out a lower surface of said floor engaging portion, a transmission operatively connected to said drive wheel and a motor drivingly connected to said transmission for selectively driving said drive wheel in forward and reverse, wherein the improvement comprises:

a transmission actuator arm pivotally mounted to said floor engaging portion adjacent to said transmission for pivotal motion about a pivot axis located generally at a central portion of said actuator arm, a manual actuator mounted to said handle portion, said manual actuator being operatively connected to said actuator arm such that when an operator actuates said manual actuator the force is transmitted from said manual actuator to said actuator arm to selectively pivot said actuator arm in first and second directions, respectively, from a neutral position such that said actuator arm actuates said transmission to place the transmission in forward and reverse, respectively; and first and second rigid protrusions extend from said handle portion and are located to engage said actuator arm at two locations spaced to either side of said pivot axis of said actuator arm when said handle portion is raised to said upright storage position, whereby said first and second protrusions place and lock said actuator arm in said neutral position when said handle portion is pivoted to said upright storage position.

2. A self-propelled vacuum cleaner according to claim 1, wherein said first and second protrusions are located such that said first and second protrusions move out of engagement with said actuator arm when said handle is pivoted to said operating position, whereby said actuator arm is free to move in said first and second directions.

3. A self-propelled vacuum cleaner according to claim 1, wherein a lower surface of said first and second protrusions are chamfered, whereby as said handle portion is pivoted from said operating position into said storage position, said chamfered lower surfaces contact and cammingly place said actuator arm in said neutral position.

4. A self-propelled vacuum cleaner according to claim 1, wherein said motor includes an output shaft;

said transmission includes an input shaft;

said floor engaging portion includes an agitator chamber that defines a downward facing suction opening, an agitator is rotationally mounted in said agitator chamber and has bristles that extend through said suction opening for agitating a floor surface; and said motor output shaft is drivingly connected to said transmission input shaft via a drive belt, and said agitator is drivingly connected to said transmission input shaft via an agitator belt.

5. A self-propelled vacuum cleaner according to claim 4, wherein said drive belt is a stretch belt that is mounted under tension between said motor output shaft and said transmission input shaft.

6. A self-propelled vacuum cleaner according to claim 5, wherein said agitator belt is a non-stretch belt that has an effective length that is greater than a distance between said transmission input shaft and said agitator, such that said agitator belt is mounted between said agitator and said transmission input shaft in a slack condition; and further comprising a means for selectively placing said agitator belt under tension for selectively driving said agitator.

7. A self-propelled vacuum cleaner according to claim 6, wherein said means for selectively placing said agitator belt under tension comprises:

an idler arm pivotally mounted to said floor engaging portion for pivotal motion about an idler axis, an idler pulley rotatably mounted on a first end of said idler arm at a location spaced from said idler axis, and a spring mounted between said idler arm and said floor engaging portion that biases said idler arm in a first direction about said idler axis into an agitator-on position in which said idler pulley is pressed against said agitator belt at a location between said transmission input shaft and said agitator, whereby said idler pulley places said agitator belt under tension for drivingly connecting said agitator to said transmission input shaft and said agitator is rotated by said motor.

8. A self-propelled vacuum cleaner according to claim 7, wherein said means for selectively placing said agitator belt under tension further comprises:

a cam protruding from a lower end of said handle portion;

wherein said cam is sized and located such that (a) when the handle portion is placed in said storage position, said cam contacts said idler arm at a location spaced from said idler axis, whereby said cam pivots said idler arm in a second direction about said idler axis, opposite said first direction, into an agitator-off position in which said agitator belt is in a slack condition and said agitator is not driven; and (b) when said handle portion is inclined into said pivotal inclined operating position, said cam moves out of engagement with said idler arm, whereby said spring pivots said idler arm in said first direction such that said idler pulley places said agitator belt under tension and said agitator is rotated by said motor.

9. A self-propelled vacuum cleaner according to claim 8, further comprising a means for selectively maintaining said idler arm in said agitator-off position when said handle portion is inclined to said operating position.

10. A self-propelled vacuum cleaner according to claim 9, wherein said means for selectively maintaining said idler arm in said agitator-off position comprises a manually actuated agitator shut-off knob slidably mounted to said floor engaging portion for selective movement between an agitator-on position and an agitator-off position, said agitator shut-off knob having a finger extending therefrom toward said agitator belt; and wherein said finger is sized and located such that (a) when said handle portion is in said storage position and said agitator shut-off knob is placed in said agitator-off position, said finger extends into a position immediately adjacent said idler arm such that when said handle portion is inclined into said operating position, said finger contacts said idler arm blocking motion of said idler arm in said first direction and thereby prevents said idler pulley from being pressed against said agitator belt, whereby said agitator belt remains in a slack condition, and (b) when said shut-off knob is placed in said agitator-on position, said finger is moved clear of said idler arm, such that when said handle portion is inclined into said operating position said idler arm is free to pivot in said first direction and said idler pulley is pressed against said agitator belt placing said agitator belt under tension.

11. A self-propelled vacuum cleaner according to claim 10, wherein said floor engaging portion further comprises an ornamental hood and said agitator shut-off knob is slidably mounted to said hood.

12. A self-propelled vacuum cleaner according to claim 8, wherein said idler arm has a second end opposite said first end, said idler axis is located between said first and second ends of said idler arm; and said cam contacts said second end of said idler arm when said handle portion is moved to said storage position.

13. A self-propelled vacuum cleaner according to claim 1, wherein said transmission includes an output shaft and said at least one drive wheel is affixed to said transmission output shaft.

14. A self-propelled vacuum cleaner according to claim 6, wherein said agitator belt is mounted to said transmission input shaft inside of said drive belt.

15. A self-propelled vacuum cleaner according to claim 6, further comprising first and second belt guides in the floor engaging portion respectively located immediately adjacent to a first expanse of said agitator belt, between said transmission input shaft and said agitator, and a second expanse of said agitator belt, between said transmission input shaft and said agitator, said first and second belt guides being located such that when said idler arm is pivoted in said second direction, said first and second expanses of said agitator belt moves radially outward until the agitator belt contacts said belt guides.

16. A self-propelled vacuum cleaner according to claim 15, wherein said agitator belt is looped around said agitator and a portion of an inner peripheral surface of said agitator chamber located opposite said agitator belt is located immediately adjacent an outer peripheral surface of said agitator belt, whereby said portion of said inner peripheral surface of said agitator chamber cooperates with said first and second belt guides to cause said agitator belt to moved away from said transmission input shaft when said agitator belt is in said slack condition.

* * * * *